United States Patent [19]

Kivimaa

[11] 4,384,600

[45] May 24, 1983

[54] CHIPPING KNIFER

[76] Inventor: Eero M. Kivimaa, Linnankoskenkatu 15 A, SF-00250 Helsinki 25, Finland

[21] Appl. No.: 212,466

[22] Filed: Dec. 3, 1980

[30] Foreign Application Priority Data

Jan. 25, 1980 [FI] Finland ..... 800225

[51] Int. Cl.[3] ..... B27G 13/00

[52] U.S. Cl. ..... 144/218; 144/230; 144/231; 144/236; 144/241; 407/48

[58] Field of Search ..... 144/218, 230, 236, 237, 144/240, 241, 231; 407/47, 48; 241/294

[56] References Cited

U.S. PATENT DOCUMENTS

| | | | |
|---|---|---|---|
| 486,269 | 11/1892 | Zimmermann | 144/236 |
| 604,813 | 5/1898 | Ward | 144/241 |
| 3,219,076 | 11/1965 | Logan et al. | 144/42 |
| 3,976,271 | 8/1976 | Larsson et al. | 144/241 |

*Primary Examiner*—W. D. Bray

*Attorney, Agent, or Firm*—Ladas & Parry

[57] ABSTRACT

A chipper knife (1) is fastened in a chuck (2). The knife has two supporting faces (15,14), which lie against two faces (25,24) in the chuck.

The fastening of the tool can be improved if the rear supporting face (15) of the knife is provided with at least one finger (1*a*), which fits into a recess in the chuck (2) and whose bottom face constitutes at least a part of the bottom supporting face (14) of the knife.

1 Claim, 10 Drawing Figures

CHIPPING KNIFER

Reliable fastening of the knife, easy to replace and to sharpen, simple construction, small size, and low manufacturing costs are requirements imposed on a good chipping knife. It is not easy to meet all of these requirements at the same time. This is particularly true of many such machines by which relatively coarse utility chips are cut off timber.

In such cases, maybe most commonly used knives are plane knives which are fastened to the base by means of bolts passing through the knife and placed far from the cutting edge of the tool. The high cutting forces directed at the knife, which tend to loosen the knife, then make the fastening unreliable. Nor is the installation of the knife always entirely simple. On the other hand, knife fastenings based on various wedge solutions are complicated.

The present construction related to a chipping knife and to its fastening to a knife holder or knife chuck, on the contrary, quite extensively meets the above requirements, and it may be applied flexibly to many different purposes of use. Its basic idea is presented in the characteristic part of the attached claim 1, to which reference is made herein.

Regarding the advantages of the present construction, it should already be stated here as follows:

The installation of the knife does not require any fitting work, the fastening screw or screws of the knife already lock the knife at a relatively low tightening force definitely reliably in all directions, the cutting forces at the knife are directed against support faces of the knife chuck placed near the cutting edge of the knife, and the sharpening of the knife can be accomplished easily.

Figure 1:
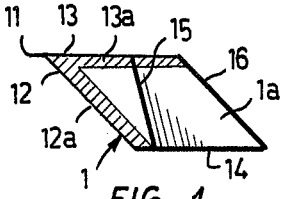
Figure 4:
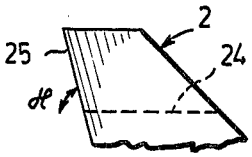
Figure 2:
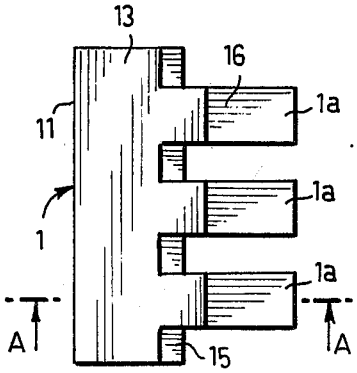
Figure 5:
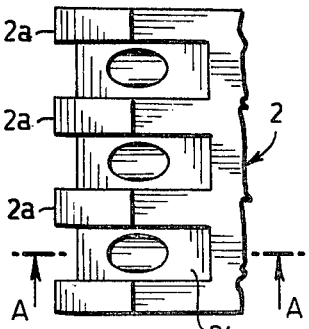
Figure 3:
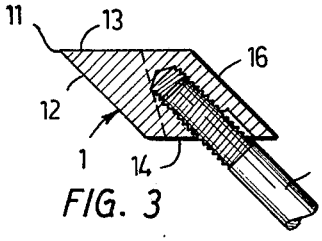
Figure 6:
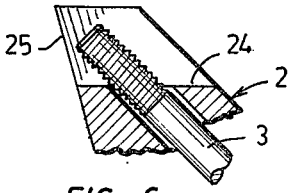
Figure 7:
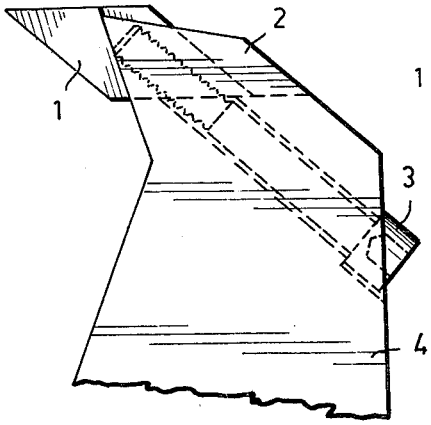
Figure 8:
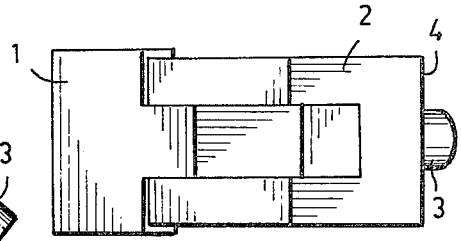
Figure 9:
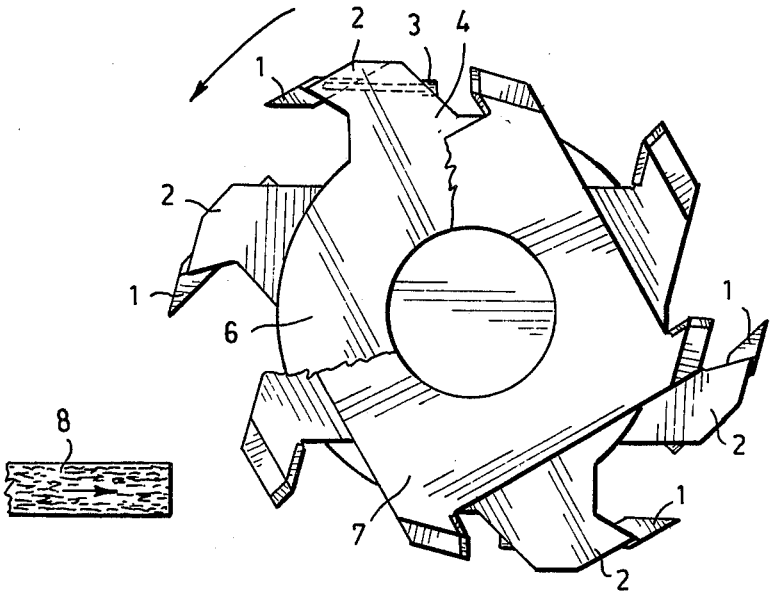
Figure 10:
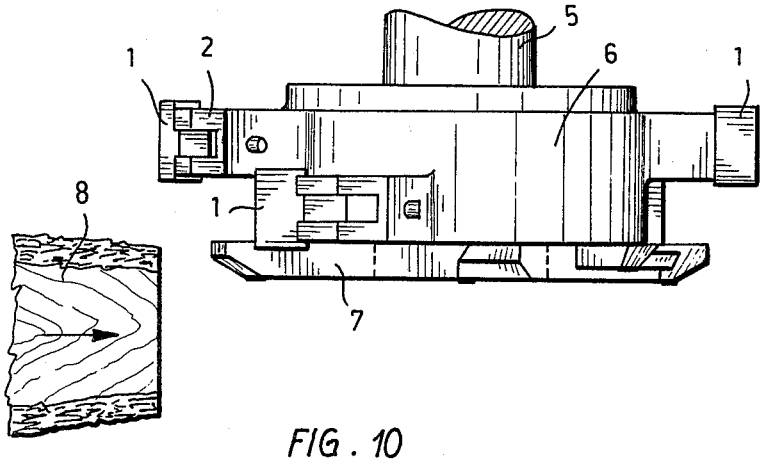

Some embodiments of the invention are illustrated by the attached schematical drawings, wherein FIG. 1 shows a knife in accordance with the invention as a side view, and FIG. 2 shows it as viewed from the top, i.e. from the side of the trailing face, and FIG. 3 shows a section along line A—A in FIG. 2, FIG. 4 correspondingly shows the knife chuck as a side view and FIG. 5 as viewed from the top and FIG. 6 a section along line A—A in FIG. 5, FIG. 7 shows a knife provided with one finger or rib as fastened to the knife arm rotating same as a side view, and FIG. 8 shows the same as viewed from the top, FIG. 9 shows a knife head of an edger-cutter as a side view and FIG. 10 as viewed from the top.

In the Figures numeral 1 denotes the knife itself as a whole, 1*a* the ribs or fingers in the knife, 11 the cutting edge, i.e. the cutting edge between the cutting face 12 and the trailing face 13 of the knife. Numeral 16 denotes the rear face of the fingers 1*a*, and numeral 14 the bottom face of the knife, which forms the support face of the knife at the fingers. The second support face of the knife is the rear support face 15 which defines with said fingers a recess in the knife. If the faces 12 and 16 are parallel, which is desireable, the sharpening-grinding of the cutting face may be performed advantageously by placing the face 16 on a magnetic table. The allowance for sharpening in the cutting-face side of the knife is illustrated by the darkened area 12*a* in FIG. 1. Correspondingly, it is desirably that the faces 13 and 14 are parallel. On the other hand, the allowance for grinding on the trailing-face side is represented by the darkened area 13*a*.

Numeral 2 denotes the knife chuck as a whole, and numeral 2*a* the fingers separated by the recesses in the socket, which fingers fit into recesses in the knife 1. The front faces 25 of the fingers are counter-faces for the support faces 15 of the knife, and the bottom faces 24 in the recesses are counter-faces for the support faces 14 of the knife 1. The knife 1 is secured firmly in position when the fastening screw 3 passing through the chuck 2 is tightened. In view of the fastening it is desirable that the angle *H* between the supporting faces 14 and 15 and between the faces 24 and 25, respectively, is acute, i.e. smaller than 90°. Further, it should be stated that the forces that during working are directed at the cutting edge 11 and the cutting face 12 of the knife do not tend to loosen the knife 1 from the chuck 2 but press the knife ever more firmly against the supporting faces 24 and 25 in the chuck.

In FIGS. 7 and 8, numeral 4 denotes the knife arm, whose upper part functions as the knife chuck 2. On the other hand, the chuck is provided with a hole for the fastening screw 3.

In FIGS. 9 and 10, which illustrates an edger-cutter knife head in accordance with the applicant's Finnish Pat. No. 55,784, numeral 5 denotes the shaft that rotates the knife head frame 6, either composed of parts or, like in this example, cast as one piece. The knife arms 4 with the knife chucks 2 included therein are then of one piece with the frame 6. A two-strip cutter ring 7 is in an appropriate way fastened to the part of the frame facing towards the timber, which cutter ring is shown in FIG. 9 partly in section and which is provided, e.g., with tungsten carbide tiped knives or "teeth". The narrow finishing strip placed next to the timber has 4 knives and the next cutter strip has 2 knives. The outermost two cutter strips have two loose knives in accordance with the invention each. The board to be edged is denoted with numeral 8.

From the figures it is seen that the construction of the knife head becomes very simple, and the knives can be favourably used even in a knife head of quite a small diameter.

Even though the cutting edge 11 of the new knife in the knife head shown in the drawing is parallel to the axis of the knife head, it may, within the construction described, also form a suitable angle of inclination k (10° to 30°) with the axis of the knife head.

Finally, it may be stated that the new knife embodiment now described may, in addition to the knife head of edger-chipper here mentioned as an example, also be used for many other cases of chipping of wood and other materials of entirely different types.

What I claim is:

1. A fastening arrangement for a wood-chipping knife comprising:

a chipper knife attachable to a knife chuck of a wood chipper by at least one fastening means, said knife comprising a body having a cutting edge, a rear support face, a bottom support face and at least one elongated member depending from said body for engagement with the knife chuck, said elongated member and said rear support face defining at least one recess, said bottom support face and said rear support face being disposed at an angle to each other, said knife chuck having supporting faces angularly disposed to each other, said angularly disposed faces of said knife chuck defining at least one recess into which said elongated member can be fitted, said angularly disposed faces of said knife chuck abutting said rear support and said bottom support face of said knife when said knife chuck and said knife are brought into engagement with each other;

whereby the tightening force of said fastening means and a cutting force directed at said cutting edge of said knife press said rear and bottom faces of said knife body against said angularly disposed faces of said knife chuck.

* * * * *